United States Patent [19]

Russello et al.

[11] Patent Number: 4,760,508

[45] Date of Patent: Jul. 26, 1988

[54] HIGH INTENSITY MODULAR LIGHT FIXTURE

[75] Inventors: Thomas Russello, Howell; Richard Sangiamo, Linden, both of N.J.

[73] Assignee: Keene Corporation, Union, N.J.

[21] Appl. No.: 937,233

[22] Filed: Dec. 3, 1986

[51] Int. Cl.[4] ..... F21V 19/02

[52] U.S. Cl. ..... 362/285; 362/372; 362/294; 362/448; 362/368

[58] Field of Search ..... 362/285, 372, 448, 294, 362/368, 362

[56] References Cited

U.S. PATENT DOCUMENTS

| | | | |
|---|---|---|---|
| 1,695,413 | 12/1928 | Crockett | 362/285 |
| 3,350,554 | 10/1967 | Wood | 362/285 |
| 3,435,202 | 3/1969 | Jablonski | 362/285 |
| 4,489,368 | 12/1984 | Sangiamo et al. | 362/285 |

*Primary Examiner*—James C. Yeung

*Attorney, Agent, or Firm*—Kane, Dalsimer, Sullivan, Kurucz, Levy, Eisele and Richard

[57] ABSTRACT

A modular light fixture is provided comprising a ballast housing, socket plate and lens assembly. The socket plate includes an inclined portion containing a socket hole and an adjacent flat portion through which mounting holes extend so that the socket may be mounted either on the incline or generally perpendicular to the flat portion. The socket assembly includes mounting means which are generally symmetrical about a horizontal axis of the plate so that either face of the plate may receive the socket. A boss containing a pin hole is provided at a corner of the plate aligned with a flange on an associated reflector housing. When the pin is in position, it prevents an inappropriate lens assembly from being positioned on the ballast housing.

2 Claims, 5 Drawing Sheets

HIGH INTENSITY MODULAR LIGHT FIXTURE

BACKGROUND OF THE INVENTION

The present invention relates to high intensity light fixtures and in particular to an improved modular construction for such fixtures.

In the design of high intensity light fixtures there are several parameters which must be taken into consideration. Thus, if the reflector is to be formed of plastic, care must be taken that the power of the fixture does not exceed 75 watts since the heat generated by a 150 watt, or even a 100 watt unit could melt and possibly ignite the plastic.

In addition, a determination must be made of the intended end use of the fixture since that could effect the desired orientation of the lamp with respect to the fixture. In some instances it will be preferable to have the lamp hang straight whereas in other applications it is desireable to have the lamp extend at an angle.

As a result of the above it has become necessry for fixture manufacturers to produce a wide range of products and dealers and distributors to handle the range. In order to minimize the inventory that must be maintained, it has become desireable to produce such fixtures in modular form. This permits the end user to select the particular lens, lamp, power pack and the like to produce the desired fixture. The use of such modular design results in an economy of parts and production costs.

A shortcoming of the use of such modular components, however, is the possible danger of the wrong components being collected which could result, possibly, in a dangerous or unsafe product.

SUMMARY OF THE INVENTION

In view of the above, it is a principle object of the present invention to provide an improved lamp socket arrangement for a high intensity light fixture which may be used in a ballast housing to provide a variety of possible lamp orientations.

A further object is to provide such a socket arrangement which may be used with conventional light sockets to support conventional lamps.

A still further object is to provide such a socket arrangement which is adapted to prevent the inadvertent use of a plastic reflector with a high power lamp.

A still further object is to provide an improved light fixture which is aesthetically pleasing and may be produced at a price competitive with conventinal fixtures.

Still other objects and advantages will become apparent from the following description of the invention.

The above and other beneficial objects and advantages are attained in accordance with the present invention by providing a light fixture comprising a ballast compartment having sidewalls defining an open top end. The open end is closed by a lamp socket plate which seats on the sidewalls. The socket assembly is generally symmetrical about a horizontal axis so that either surface of the plate may be directed toward or away from the ballast housing to support a lamp socket in different orientations extending away from the ballast housing. In one orientation, designed to receive a low energy lamp socket a plastic reflector may be positioned over the ballast housing. In the other orientation, designed to receive a high energy lamp socket, a pin extends from the socket plate to interfere with flanges molded into the plastic reflector to thereby prevent the plastic reflector from inadvertently being assembled on a fixture with a high energy lamp.

DETAILED DESCRIPTION OF THE PREFERRED EMBODIMENT

Figure 1:
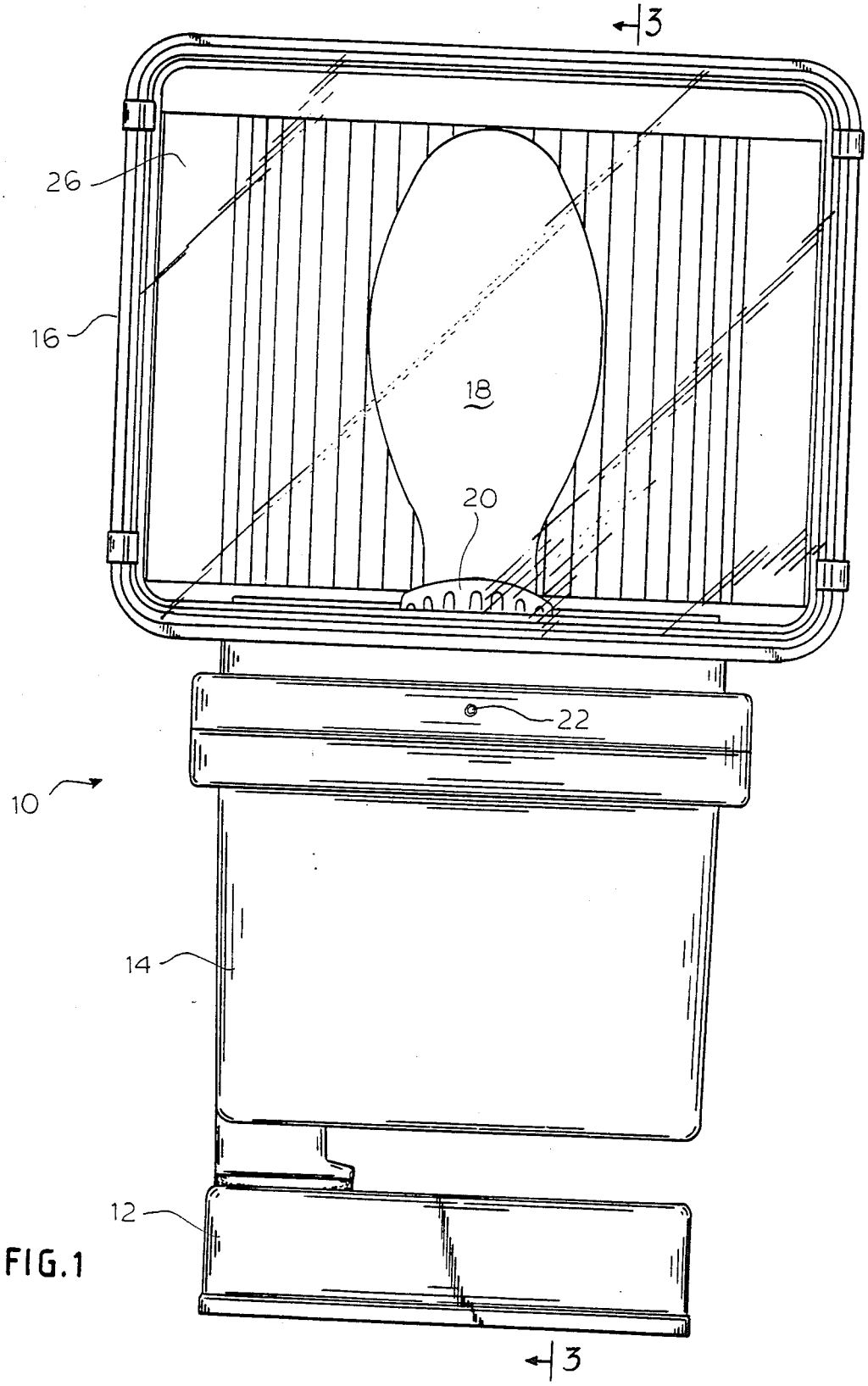
FIG. 1 is a perspective view of a high intensity light fixture in accordance with the present invention incorporating a first form of reflector.
Figure 2:
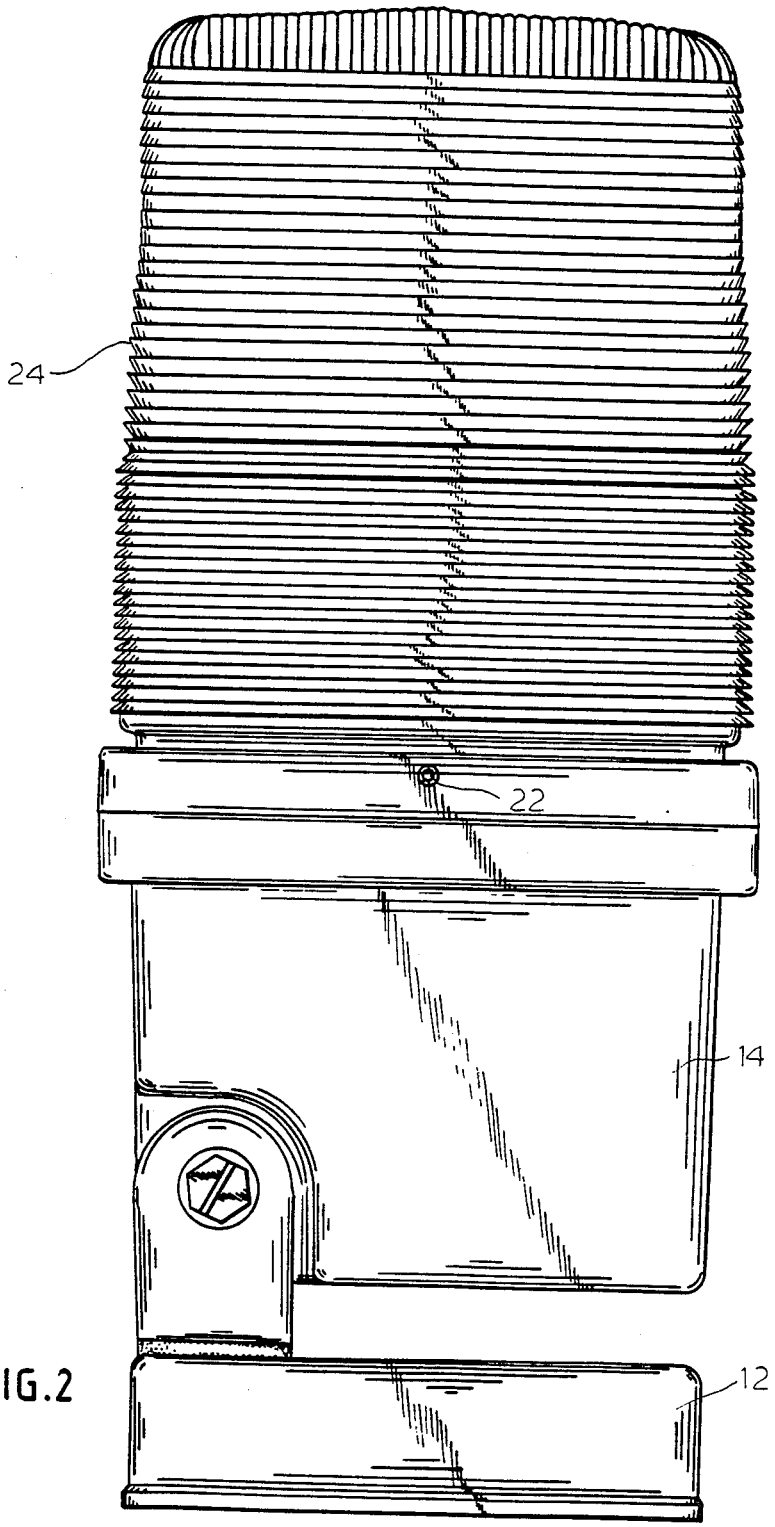
FIG. 2 is a view similar to FIG. 1 with the light fixture incorporating a different form of reflector.

Reference is made to the drawings and to FIG. 1 in particular wherein a fixture 10 is depicted as comprising a base or mounting plate 12, a ballast housing 14, and a reflector housing 16. The housing 14 contains the ballast and wiring for the lamp 18. To this end, the lamp socket 20 is connected to the ballast housing to support the lamp . within the reflector housing 16. The reflector housing fits over a collar on the ballast housing and is held in position by a set screw 22. By loosening the set screw 22, the housing 16 may be replaced with another housing 24 as shown in FIG. 2. Housing 24 is formed of plastic molded to provide a plurality of prism elements. Housing 16 is formed of metal having a reflector element and glass lens 28A.

Figure 3:
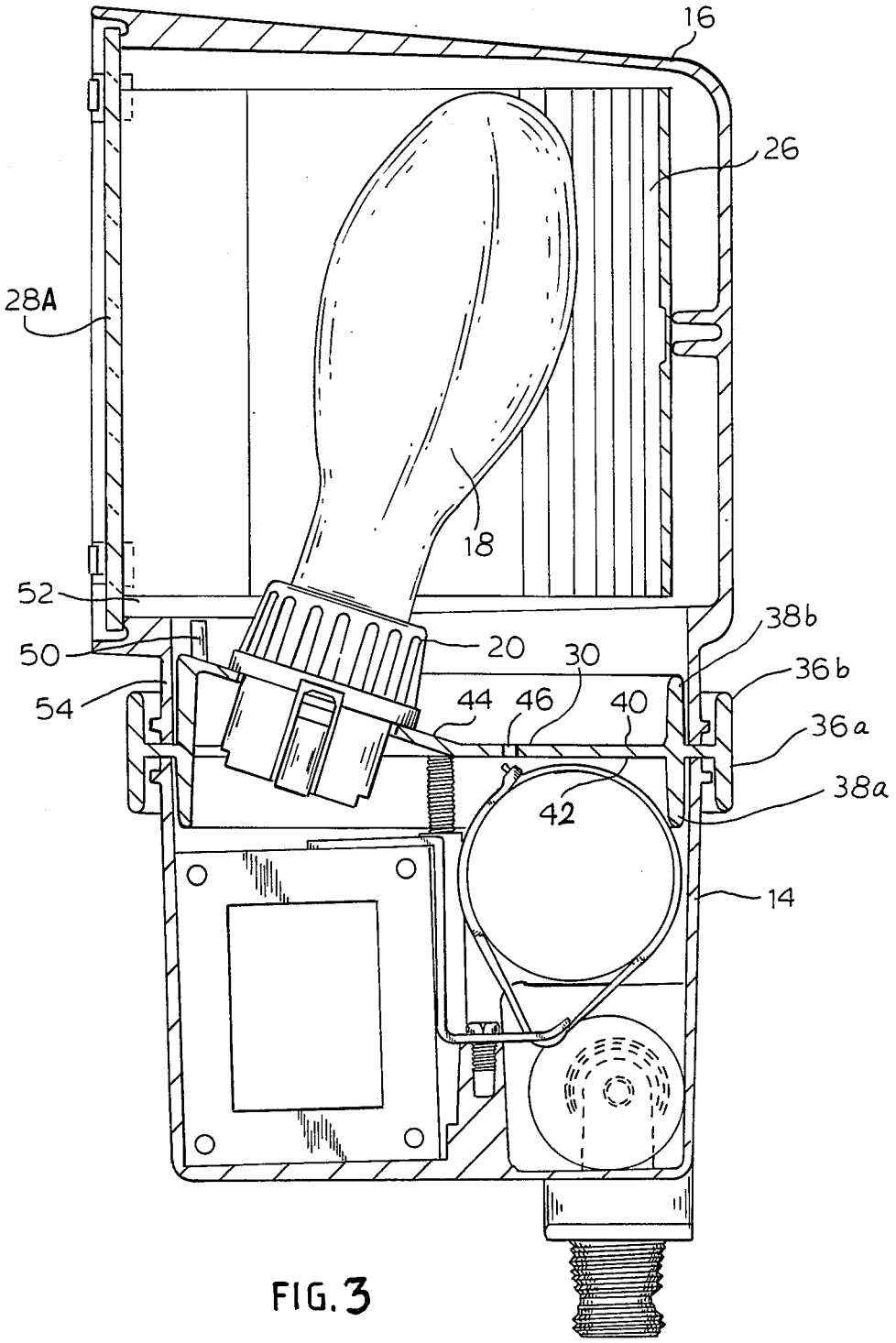
FIG. 3 is a side elevational sectional view of the fixture of FIG. 1.

Referring to FIG. 3, it can be seen that the ballast housing 14 is formed with an open top end that is closed by a socket plate which seats on top of the housing walls. The socket 20 extends through an opening in the socket plate to support the lamp. To this end, the socket plate opening 32 is provided with cutouts 34 which permit flanges on the socket to pass. After the socket is inserted the flanges pass the cutouts and are locked in position.

Figure 5:
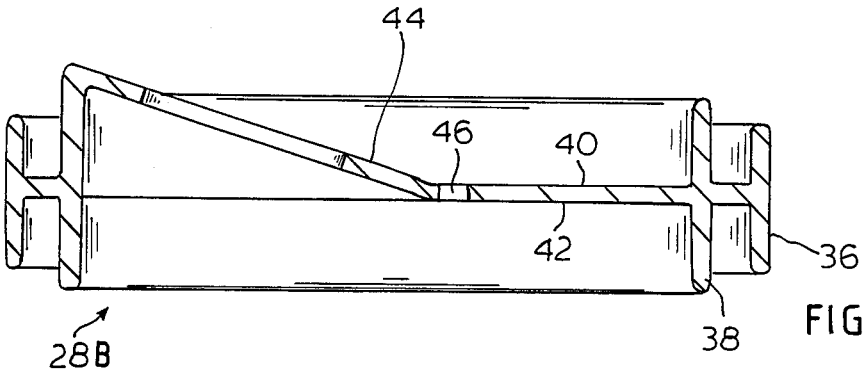
FIG. 5 is a sectional view taken along reference line 5—5 of FIG. 4.
Figure 4:
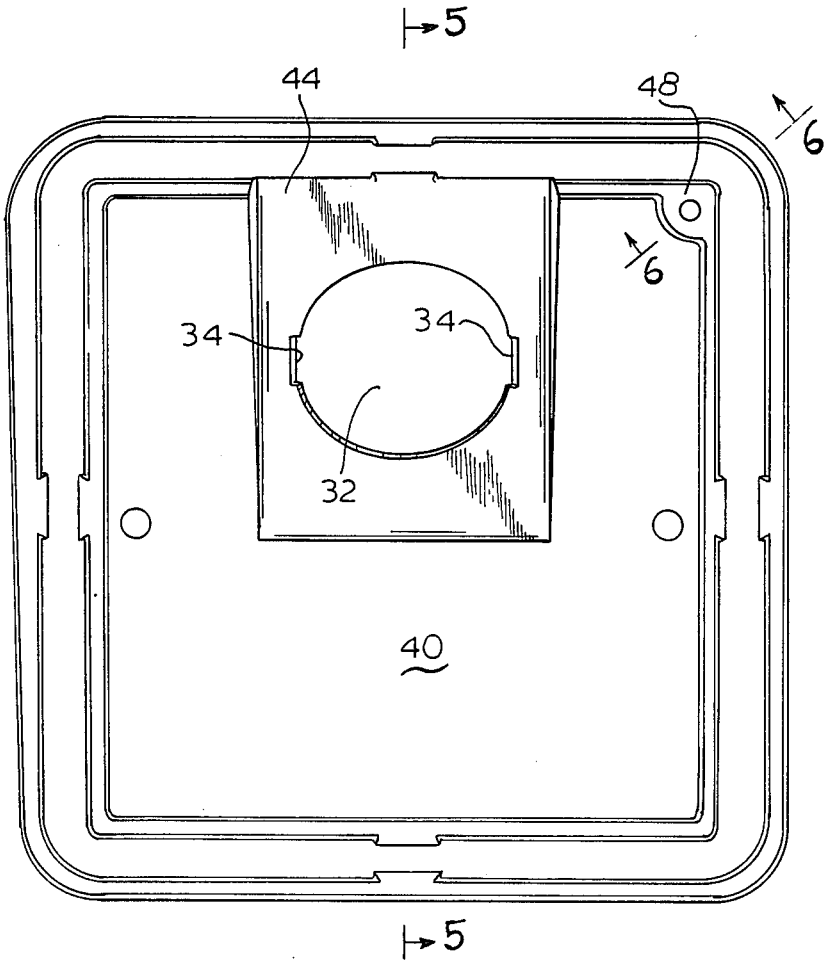
FIG. 4 is a top plan view of one side of the socket plate of the present fixture.

Referring to FIG. 5 it can be seen that the socket plate 30 is provided with a pair of spaced flanges **36*a*, 38*a* for engagement with the top of the ballast housing sidewalls and 36*b*, 38*b* for engagement with the reflector housing. In this regard, it should be noted that the flanges 36*a*, 38*a* are generally symmetrical with the flanges 36*b*, 38*b* about a horizontal axis extending through the socket plate so that the socket plate can be mounted on the housing sidewall with either face 40 directed upwardly (as shown in FIG. 3) or reversed, with face 42** facing upwardly.

As shown in FIG. 3, the socket plate 28B includes an inclined section 44 that extends upwardly from face 40. The socket opening 32 is positioned in the inclined section to hold the lamp 18 at an angle. A pair holes 46 are provided in the flat section of the 28B and are threaded to receive screws from face 42 to hold a socket assembly generally perpendicular to the flat section of the socket plate.

Figure 6:
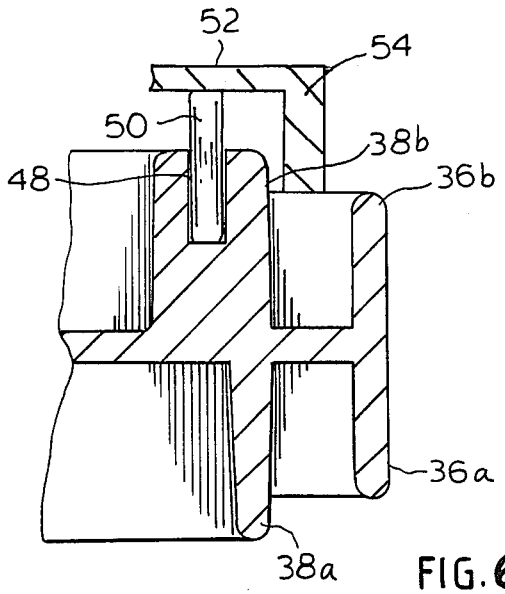
FIG. 6 is a sectional view taken along reference line 6—6 of FIG. 4.
Figure 7:
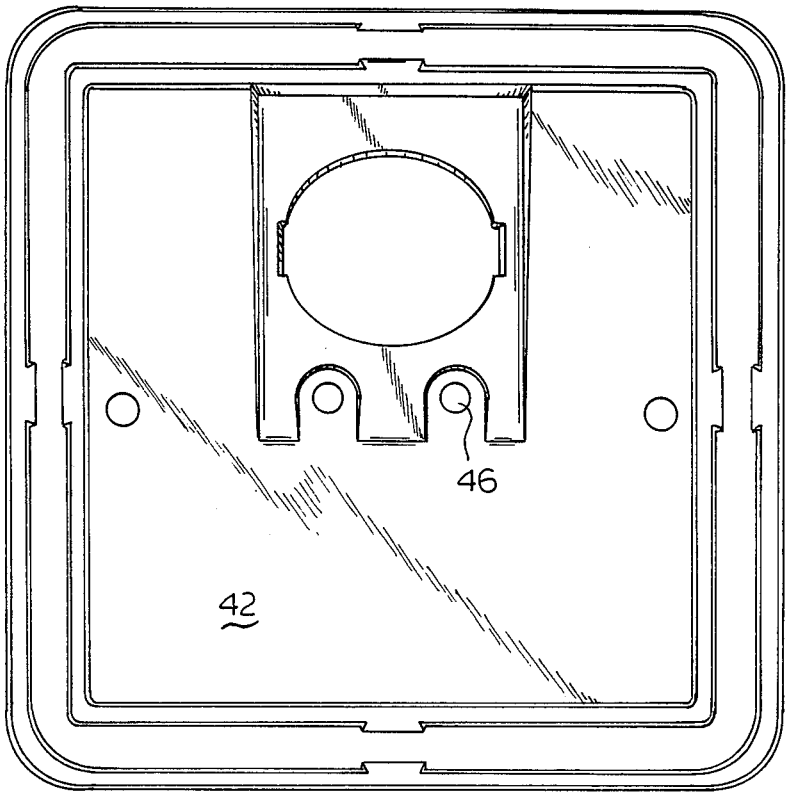
FIG. 7 is a plan view opposite that of FIG. 4 depicting the other side of the socket assembly plate.

An important feature of the present invention resides in the provision of boss 48 which serves to receive a pin 50, if necessary. The pin serves to interfere with a wedge 52 of an inappropriate reflector housing to prevent the side 54 of the reflector housing from seating between the flanges 36*b*, 38*b*. Thus, in the depicted embodiment of the invention set forth in FIG. 3, the glass and metal reflector housing can withstand the heat generated by a high power lamp and hence the reflector housing flange 52 is positioned sufficiently high so as to clear the top of pin 50 the reflector is positioned on top of the ballast housing. In the event the ballast housing contained low power components the pin would not be provided and hence there could be no interference. On the other hand, as shown in FIG. 6, if an attempt were made to assemble a plastic reflector (such as shown in FIG. 2) to the ballast housing containing high power components, the pin 50 would interfere with flange 52 to prevent the reflector from seating on the ballast housing. Since the pin would not be used in the event low power components were to be used, the plastic reflector assembly could seat on the ballast housing containing the low power components.

Thus, in accordance with the above, the ballast housing and socket plate can be used to form a wide variety of fixtures. By choosing the appropriate face of the plate to face upward, the lamp socket can be oriented to extend at an angle or straight up. Further by providing or omitting the pin 50 the ballast housing can be assembled for high or low energy components and only an appropriate lens housing can be assembled onto the housing.

Thus, in accordance with the above, the aforementioned objects are effectively attained.

Having thus described the invention, what is claimed is:

1. A light fixture comprising:

a ballast housing having sidewalls defining an open top end;

a lamp socket plate having top and bottom surfaces seated on said housing closing said top end, said plate including means for engagement with said sidewalls, said means being generally symmetrical about a horizontal axis whereby either said top surface or said bottom surface may be directed toward said housing, said plate including a generally flat portion and a portion inclined with respect to said flat portion;

a lamp socket assembly secured to said plate and including means for engagement with said plate whereby to support a lamp generally perpendicular to said inclined portion or generally perpendicular to said flat portions; and, a reflector assembly secured to said housing.

2. The light fixture in accordance with claim 1 wherein said reflector assembly includes a flange adjacent a lower edge thereof and said boss includes a pin receiving boss aligned with said flange whereby a pin of sufficient length positioned in said boss would interfere with said flange and thereby present said reflector assembly from seating on said housing.

* * * * *